United States Patent [19]

Anderson

[11] Patent Number: 4,527,064

[45] Date of Patent: Jul. 2, 1985

[54] IMAGING ALPHA PARTICLE DETECTOR

[75] Inventor: David F. Anderson, Los Alamos, N. Mex.

[73] Assignee: The United States of America as represented by the United States Department of Energy, Washington, D.C.

[21] Appl. No.: 510,388

[22] Filed: Jul. 5, 1983

Related U.S. Application Data

[63] Continuation of Ser. No. 202,042, Oct. 29, 1980.

[51] Int. Cl.[3] ..... H01J 47/10

[52] U.S. Cl. ..... 250/374; 250/379; 250/389

[58] Field of Search ..... 313/93; 250/389, 385, 250/374, 375, 379, 381

[56] References Cited

U.S. PATENT DOCUMENTS

| | | | |
|---|---|---|---|
| 3,461,293 | 8/1969 | Horwitz | 250/389 |
| 3,723,788 | 3/1973 | Goto | 250/389 |
| 3,787,746 | 1/1974 | Atac | 250/374 |

OTHER PUBLICATIONS

Kobayashi, "Self-Triggering Streamer Chamber and Its Applications to Nuclear Physics", Memoirs Faculty of Science, Kyoto Univ., Series of Physics, Astrophysics, Geophysics & Chemistry, vol. 23(3), Art. S., 1971, pp. 325-337.

Stubbins et al., "Diminutive Corona Spark Detectors for Fission Fragments", Nucl. Instru. & Methods, 95, 1971, pp. 533-539.

Price, "Nuclear Radiation Detection", McGraw-Hill, N.Y., 1969, pp. 151-154.

Eichholz, "The Rosenblum Spark Counter", Nucleonics, 10(10), Oct. 1952, pp. 46-49.

Kosakov, "Wide-Gap Spark Chamber with Mylar Walls", Instrum. & Exp. Tech. (USA), 19(4), Jul.-Aug. 1976, pub. 1-77, pp. 1014-1015.

Aoyama, "Selecting Spark Based on the Difference of Specific Ionization of High Energy Charged Particles Incident on a Self-Triggering Spark Chamber", Radioisotopes, 24(5), May 1975, pp. 305-310.

Aoyama, "A Hybrid Spark Chamber for Measuring Radionuclide Distributions", Nuc. Instru. & Methods, 150, 1978, pp. 203-208.

Yin, "A Portable X-Ray Imaging System for Small-Format Applications", Nuc. Instru. & Methods, 158, 1979, pp. 175-180.

Lansiart, "Spark Chambers in Nuclear Medicine", Nucleonics 24(3), Mar. 1966, pp. 56-60.

*Primary Examiner*—Alfred E. Smith
*Assistant Examiner*—Carolyn E. Fields
*Attorney, Agent, or Firm*—Samuel M. Freund; Paul D. Gaetjens; Judson R. Hightower

[57] ABSTRACT

A method and apparatus for detecting and imaging alpha particles sources is described. A conducting coated high voltage electrode (1) and a tungsten wire grid (2) constitute a diode configuration discharge generator for electrons dislodged from atoms or molecules located in between these electrodes when struck by alpha particles from a source (3) to be quantitatively or qualitatively analyzed. A thin polyester film window (4) allows the alpha particles to pass into the gas enclosure and the combination of the glass electrode, grid and window is light transparent such that the details of the source which is imaged with high resolution and sensitivity by the sparks produced can be observed visually as well. The source can be viewed directly, electronically counted or integrated over time using photographic methods. A significant increase in sensitivity over other alpha particle detectors is observed, and the device has very low sensitivity to gamma or beta emissions which might otherwise appear as noise on the alpha particle signal.

10 Claims, 2 Drawing Figures

IMAGING ALPHA PARTICLE DETECTOR

The present invention relates generally to detection of alpha particles and more particularly to a portable, self-triggering imaging spark chamber. This invention is the result of a contract with the Department of Energy (Contract No. W-7405-ENG-36).

This is a continuation of application Ser. No. 202,042 filed Oct. 29, 1980.

BACKGROUND OF THE INVENTION

There has been a long-standing need for mapping extended sources for radioactive "hot spots." Increasing industrial and military use of plutonium and other alpha particle emitters has most definitely exacerbated the risk of personnel contamination. In particular, radioactive materials can enter wounds resulting from accidents. Such wounds require immediate detection and treatment. At present, portable, reasonable resolution detectors of radiation which could be used to examine wounds and localize contaminated areas are gamma radiation detectors, there being no equivalent device for alpha particles. As such, these devices are useless in evaluating plutonium contamination because plutonium is a strong alpha particle emitter, but only a weak gamma ray source. Although sensitive alpha particle detectors exist, they are large, nonportable and have poor spatial resolution. They provide a simple yes-no answer to the question of decontamination necessity. A positive finding could lead to time consuming, unpleasant, and perhaps unnecessary cleansing procedures when a localized, more effective one would be advantageous. That is, it might appear from a whole body count that a person was "hot" enough to require general decontamination when in actuallty, a small, highly radioactive area such as a wound or under fingernails demands immediate and specialized treatment. Indeed, the value of a sensitive, high spatial resolution device is apparent for emergency situations where time is of the essence.

The instant invention is a self-triggering spark chamber and method for alpha particle monitoring and imaging. My device can be used, among other things, for scanning a contaminated individual directly to quickly localize the affected area even in a fully lighted room in order that accurate, quantitative decisions can be made concerning the approach to meeting the crisis. Although the device of this invention describes a handheld viewing screen in a two electrode configuration into which the charged particles pass through a thin window rather than the radiation source being placed in the chamber gas, the device can be enlarged to enable viewing of large portions of the subject under investigation with no loss in sensitivity or resolution. Radiation can also be electronically counted or integrated over time as a photograph. Alpha particles are detected from the electrical discharges they produce upon entering the spark chamber. Such particles are generally sufficiently energetic that they can dislodge electrons from atoms or molecules into which they collide. Many such collisions occur before the alpha particle is slowed sufficiently so as to be ineffective in producing additional free electrons. Under the influence of the applied electrostatic field, the freed or unbound electrons are accelerated producing more electrons as they collide with atoms and molecules in their way during their journey to the more positive electrode. This so-called "avalanche" causes a visible spark to appear. Such sparks can be easily observed with the unaided eye or detected using electronic counting methods. The background events measured by the instant invention are low because the device doesn't detect either gamma rays or beta particles with significant efficiency. Therefore, the specificity and sensitivity for alpha emissions is high, and the device serves well as a plutonium detector. Among other uses for my instrument are the determination of the uniformity of planar alpha particle emitters used for radiation effect investigations, and the search for radioactive "hot spots" on air filters to decide whether the contamination is a fine dust or a single particle. Dust implies greater danger to personnel while the particle may be spurious.

The present invention relates generally to detection or alpha particles and more particularly to a portable, self-triggering, imaging spark chamber. This invention is the result of a contract with the Department of Energy (Contract No. W-7405-ENG-36).

Four relevant references should be discussed to adequately place the present invention with respect to existing art. It should be mentioned that three out of the four references teach gamma radiation and beta particle detection, neither emission being sufficiently closely related to alpha particles in their ionization characteristics to be illustrative in the design of the instant invention.

1. "Spark Chambers in Nuclear Medicine," by A. J. Lansiart and C. Kellershohn, Nucleonics 24, 56 (1966), describe a xenon filled, self-triggering spark chamber for use in detecting gamma rays in nuclear medicine investigations. The device would require major redesigning to be useful for alpha particle detection which redesigning the article does not teach. First, the lead collimator and aluminum cathode would have to be removed and replaced by a window material which simultaneously transmits alpha particles and can maintain the necessary gas-tight characteristics. Second, and most important, the sizable detection gap which is used to give some gain or multiplication to the charge deposited by the gamma radiation in the xenon gas mixed with a small amount of methylal would simply result in a "smeared-out" and therefore useless profile of the emitting source. That is, alpha particles ionize significant numbers of atoms or molecules in gases they come in contact with, whereas gamma radiation and beta particles are nowhere near as efficient in producing charge particles upon collision with neutral species. As a result, the additional path for amplification of charge provided in the Lansiart and Kellershohn device would produce a broad avalanche of electrons at every point along the path of the incident alpha particles thereby destroying the desired resolution of an imaging device. Finally, the referenced device teaches a triode (cathode, grid, anode) configuration while for our invention, a simpler diode design (grid, anode) is quite adequate because of the ionization efficiency of the alpha particles. The instant invention is therefore not suggested by the Lansiart and Kellershohn article.

2. "A Hybrid Spark Chamber for Measuring Radionuclide Distributions," by Takahiko Aoyama and Tamaki Watanabe, Nuclear Instruments and Methods 150, 203 (1978), again teaches away from the diode design of our invention by describing a beta particle detector. The window transmission problem is solved by putting the radiation source inside a sealed envelope which is flushed with argon saturated with ethanol.

This procedure, of course, renders the apparatus virtually useless for the emergency applications planned and demonstrated for the instant device. Moreover, the gap between the cathode grid and the ground plane grid, which is critical for amplifying the charge deposited in the gas by the beta particles in the triode arrangement, as described supra, destroys the desired resolution of the apparatus when used to detect ionizing alpha particles. It is specifically mentioned in the reference that at the high voltages needed to efficiently detect beta particles, a diode configuration is unstable; hence the move to a triode design, and away from our invention. Finally, although the reference explicitly mentions expansion of the device area to about 400 $cm^2$, the instrument described is designed to detect beta particles and would require major redesign, which is not taught in the reference, to detect alpha particles with the sensitivity and spatial resolution of the instant invention.

3. "A Portable X-Ray Imaging System for Small-Format Applications," by Lo I. Yin, Jacob I. Trombka and Stephen M. Seltzer, Nuclear Instruments and Methods 158, 175–180 (1979), teaches a compact, portable gamma radiation detector. However, the device cannot detect alpha particles without modification, again not taught by the reference. Further, the apparatus does not utilize the spark chamber design taught by the above two references and the instant invention, the price which one pays being the restriction of the viewing area. Finally, the device cannot be used unless the background lighting is subdued. This is in contrast with the instant invention which can be used in a lighted room.

4. "Selecting Spark Based on the Difference of Specific Ionization of High Energy Charged Particles Incident on a Self-Triggering Spark Chamber," by Takahiko Aoyama, Kazuaki Kamata, Yoshimitsu Kobayashi and Tamaki Watanabe, Radioisotopes 24, 305 (1975), is an article by two of the authors of Ref. 2, supra. A source of either beta or alpha particles is placed inside the vacuum envelope of the apparatus and sparks are observed under appropriate voltage conditions. A diode configuration is taught and selective detection of either betas or alphas can be achieved by simply adjusting the applied voltage. Reference 4 is written in Japanese, but a careful reading of the English abstract and the figures included in the article leads us to the following conclusions. Reference 2, supra, mentions that the detector characteristics of the earlier device (Ref. 4) are good for alpha particles, but must be modified for improvement in stability and sensitivity when used for beta particles. However, the placement of the radiation source inside the envelope does not allow use of the device for wound monitoring, as does our invention, and no mention is made of the resolution of the image obtained. Reference 4 appears therefore to be a study of the voltage characteristics of the type of device without any consideration of its use as a practical radiation detector, while Ref. 2 carries Ref. 4 to a more practical point by considering the resolution of a triode device. Neither teaches the use of a specifically chosen window material to allow passage of alpha particles from an external source and the resulting visual inspection of the emitting source, as does the instant invention. Neither teaches the use of a small electrode spacing such that only alpha particles are detected without the presence of gamma or beta radiation background counts.

SUMMARY OF THE INVENTION

A general object of our invention is to provide increased sensitivity and spatial resolution, low cost, large area visual or electronic detection of alpha particles.

Another object of the invention is to enable visual observation of the details of sites of alpha particle-contamination rapidly, locally and with high spatial resolution.

Yet another object of the invention is to identify surface contamination by plutonium bearing compounds.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the apparatus of this invention may comprise two electrodes, one a conducting coated and light transparent glass plate which also serves as one side of the gas envelope of the detector, the other a significantly transparent wire grid which is kept at a negative potential relative to the glass electrode. The other side of the gas envelope is a thin polyester film, alpha particle and light transparent window such as that listed under the trademark of Mylar from E. I. duPont de Nemours and Co.; the remaining four sides of the volume are provided by a stainless steel and plexiglas supporting structure with appropriate seals. The combination is also transparent to light providing "see-through" capability.

In a further aspect of the present invention, in accordance with its object and purposes, the method hereof may comprise the use of an argon-isobutane mixture which can be premixed.

Several advantages derive from the instant invention. The compact design allows portability, low cost and high spatial resolution. The "see-through" capability of the device provides great simplicity of use. The background noise of this device is very low because of its very poor detection efficiency for beta particles and gamma radiation, and the alpha particle-induced sparks can be observed in a reasonably bright room. Finally, and most importantly, we have unexpectedly found that the measured efficiency of our device for alpha particle detection is significantly better than for existing proportional counters used for such purposes. That is, we have measured a typical efficiency of 66%, while other air and gas proportional counters have efficiencies of less than 50%. Efficiency is measured by electronically counting the sparks produced by the alpha particles rather than by simply observing them visually.

BRIEF DESCRIPTION OF THE DRAWINGS

The accompanying drawings which are incorporated in and form a part of the specification, illustrate an embodiment of the present invention and, together with the description, serve to explain the principles of the invention. In the drawings.

DETAILED DESCRIPTION OF A PREFERRED EMBODIMENT OF THE INVENTION

Figure 1:
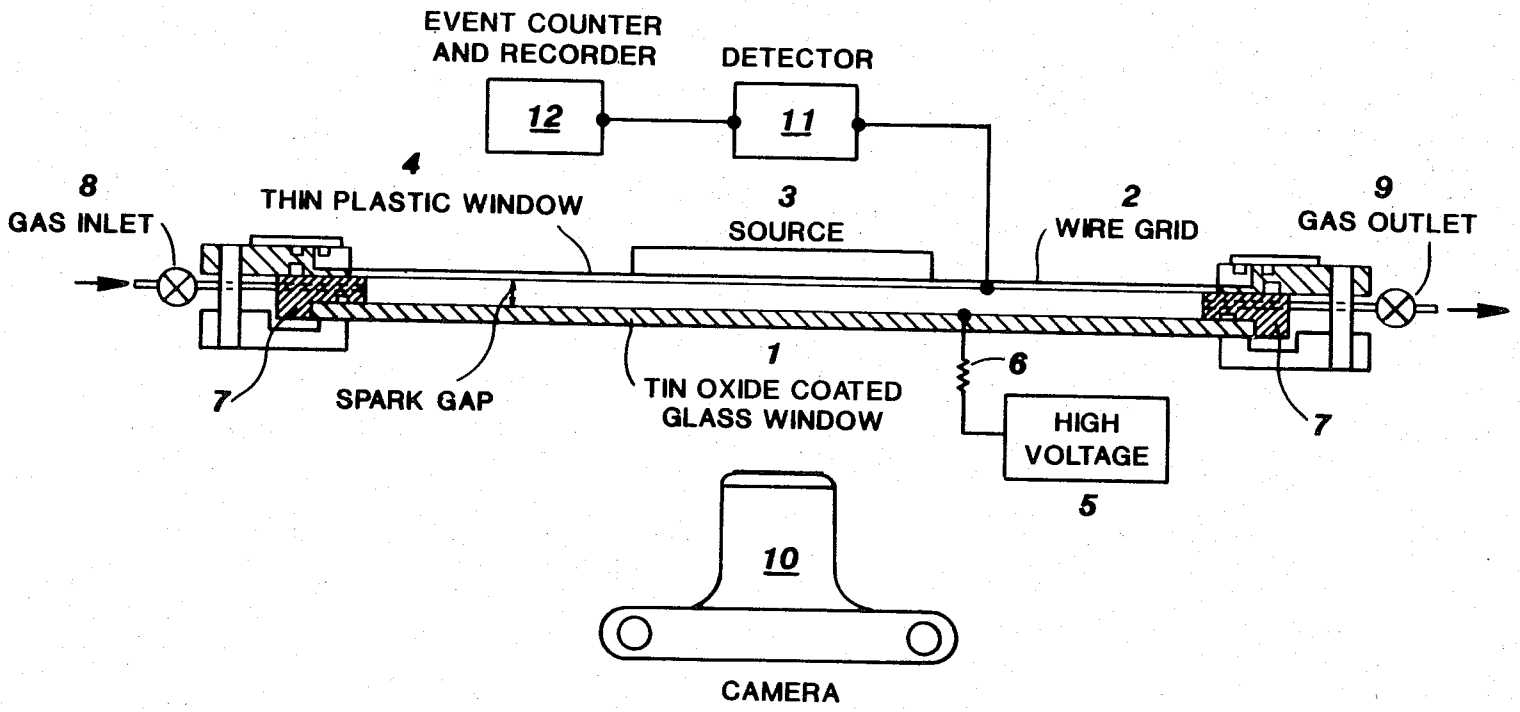
FIG. 1 is a schematic of the detector head (drawn to scale) showing the relative dimensions of the vacuum envelope and the electrode configuration.

Reference will now be made in detail to the present preferred embodiment of the invention, an example of which is illustrated in the accompanying drawings. FIG. 1 shows the basic construction of the spark chamber which is the heart of the instant apparatus and method. The high voltage electrode 1 is a glass plate coated with tin oxide having a resistance of 20 ohms per square across the plate. Any conductive coating will work but 20 ohms per square tin oxide was chosen because of its excellent optical transparency. Resistances between zero and several hundred ohms per square provide a reasonable working range for the apparatus. Means 5 are provided for maintaining said electrode at a positive potential. Preferably, such means includes a power supply of batteries connected to the electrode through a 20 million ohm resistor 6. The voltage for maximum detection efficiency is chosen by increasing this quantity until the detector fires continuously and without the presence of alpha particles, and then lowering the voltage until stable operation occurs. The voltage range which is optimum depends on the electrode spacing, the altitude at which the detector is being used (that is, the pressure) and the gas mixture. The 20 million ohm charging resistor is chosen for convenience and is not critical. The resistance must simply be large enough to quickly terminate the sparking, yet small enough to allow a reasonable counting rate which is not substantially limited by circuit time constant. The second electrode 2 is a grid of 0.02 cm diameter tungsten wires with 1.27 cm spacing between wires. Neither the dimensions nor the composition of this grid is critical. This electrode is held at ground potential. The two electrodes are separated at the edge by a 0.4 cm thick plexiglas spacer or other insulating material with good vacuum properties 7. The spacing can be between 0.2 and 0.4 cm. Below 0.2 cm, arcing is expected, while above 0.4 cm, the applied voltage required at the maximum efficiency point is inconveniently high and the spatial resolution deteriorates. A thin, durable, transparent, gas tight polyester film such as that listed under the Trademark of Mylar from E. I. duPont de Nemours and Co. window 4 is placed outside of the wire electrode to complete the gas volume. It is supported by wires spaced at about 0.64 cm. This is also not a critical dimension. The plexiglas spacer 7 has both inlet 8 and outlet 9 ports to allow gas to flow through the spark chamber. The gas is vented to the atomsphere. The tin oxide coating on the glass electrode is positioned to be inside the gas volume facing the wire grid, and is sufficiently thin such that the polyester film, grid and glass assembly taken as a unit is transparent to light. This allows the subject under investigation 3 to be viewed directly through the detector head and/or photographs 10 to be taken. Contamination can be electronically counted 11, 12 as well, again while the subject is being scanned by the observer.

The imaging alpha detector of the instant invention has been made portable, the spark chamber being placed on the end of an umbilical cord and away from the power source and electronic measuring devices. The charged particles enter the head through the polyester film window from an external source as opposed to placing the radiation emitter to be measured inside the detector head. Finally, an argon-isobutane (about 99%-1% by flow measurement) mixture at approximately atmospheric pressure provides the target gas which is responsive to the incoming alpha particles. The isobutane concentration can be increased to approximately 5% without changing the results. Below about 1% the device becomes unstable to applied voltages. The role of the isobutane is thought to be the quenching of excited electronic states which lead to unwanted discharges. At over about 5% concentrations, the system is over-quenched and excessive voltages must be applied to achieve optimal response to alpha particles. An advantage of this particular combination is that it can be premixed in a small gas bottle as opposed to requiring mixing at the instant of use.

It was found that the efficiency of detection of the instant invention for alpha particles was applied voltage dependent, as would be expected. However, when 2210 V was applied to the first electrode, the typical measured efficiency for alpha particles from a plutonium standard source was 66%. Higher applied voltages gave yet higher efficiencies, but the device became unstable. The spatial resolution in the direction perpendicular to the wire grid was about 0.2 cm with much better resolution (about 0.05 cm) occurring for alpha particles traveling along the wires.

Figure 2:
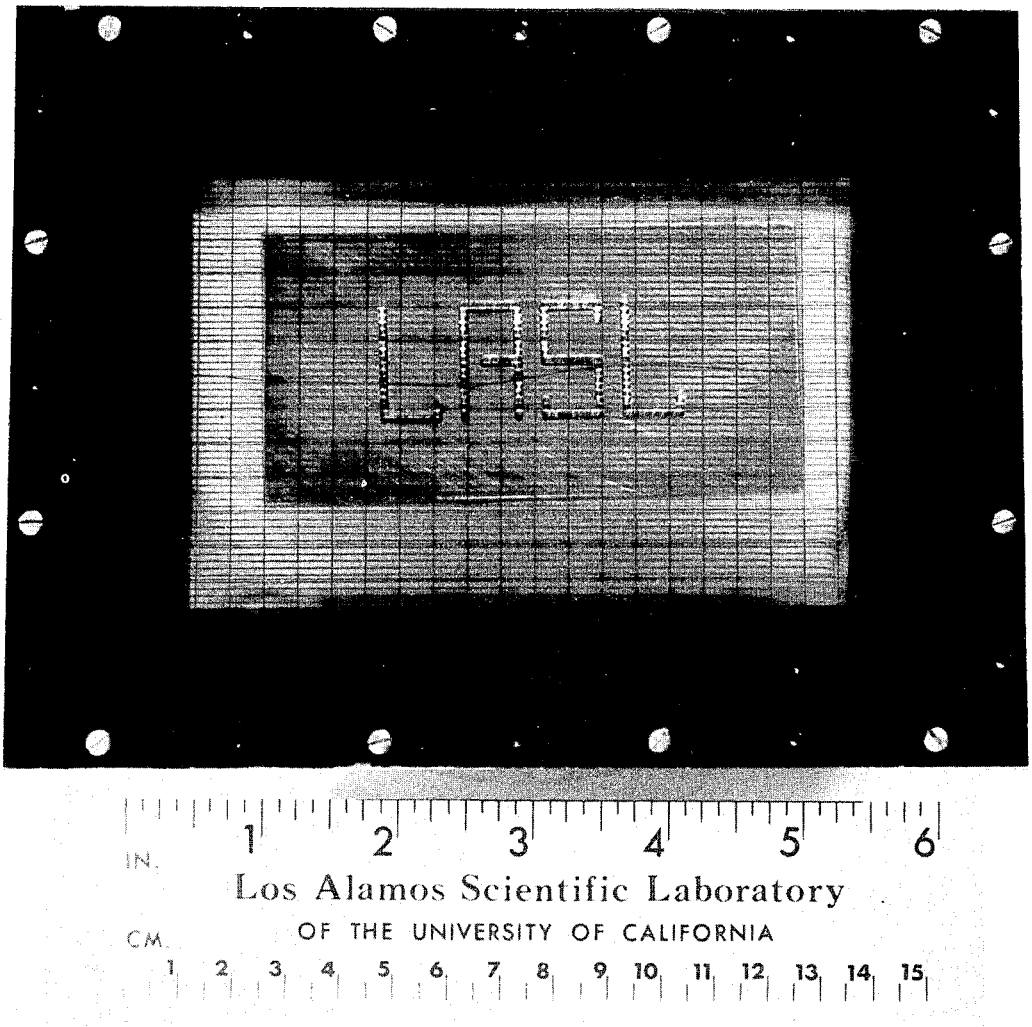
FIG. 2 is a doubly exposed photograph of the detector head in use imaging a mask with 2 cm high letters which is placed between the instrument and a large, planar plutonium alpha particle source through the resulting sparks.

FIG. 2 shows the use of the alpha imaging detector in its visual display mode. A mask with 2 cm high letters is placed between the detector and a large, planar plutonium source. The white spots demarking "LASL" are the actual sparks produced when alpha particles emerging from the mask enter the polyester film window, each producing an electric discharge in the detector head. The enclosure surrounding the display area is the head itself. Obvious from the figure is that the source of the radiation can be viewed directly as can be the effect of the emitted alpha particles. This allows ready location of the source since the spark pattern reproduces its geometry with substantial resolution and fidelity.

In summary, an alpha particle imaging device and method are described whereby one may accurately and quantitatively locate and describe the source of alpha emissions. The invention utilizes the interaction between energetic alpha particles and molecules or atoms. Upon collision with such alpha emissions, electrons are removed from the neutral species and if an appropriate electric field is applied, a discharge will result, approximately one for each alpha particle, which is characteristic of the geometry of the emitting source. Such discharges may be observed with the unaided eye as sparks outlining the image of the emitter, or counted with electronic counters producing a quantitative analysis of the source strength. The device does not detect gamma or beta emissions which commonly contribute to the background noise of other particles detectors with significant efficiency. Our invention is therefore very specific to alpha particles. Quite unexpectedly, the sensitivity of the device of this invention was found to be much greater than previously reported devices, and its portability, see-through capability and simplicity render it very useful as an alpha particle monitor.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An apparatus for displaying and quantitatively detecting primarily a source of alpha particle emission, whereby improved resolution and noise background for the alpha particle emission display and detection is achieved at relatively low applied voltages, said apparatus comprising in combination:

a. a pair of electrodes which further comprises:
   i. a planar wire grid; and
   ii. a light transparent, conducting coated electrical insulating flat plate situated parallel to said grid and separated therefrom by at most 0.4 cm, said conducting coating being deposited on the side of said plate facing said grid, said plate further forming a first major side of a gas tight envelope;

b. an alpha particle and light transmitting window adjacent to and parallel to said wire grid, and located on the opposite side of said grid from said plate, said window forming a second major side of said gas tight envelope;

c. means simultaneously secured to said plate and said window for completing said gas tight envelope, and for supporting said electrodes and window;

d. means for introducing and removing target gases from said gas tight envelope, said gases occupying the volume between said window and said conducting coated electrode;

e. means for maintaining said pair of electrodes at particular voltages in order to accelerate electrons released by collisions between alpha particles incident on said volume and said target gas located therein, therby forming a visible spark discharge; and f. means for quantitatively detecting and recording said spark discharges resulting from said alpha particle collisions.

2. An apparatus for displaying and quantitatively detecting primarily a source of alpha particle emission, whereby improved resolution and noise background for said alpha particle emission display and detection is achieved at relatively low applied voltages, said apparatus comprising in combination:

a. a pair of electrodes which further comprises:
   i. a planar wire grid;
   ii. a light transparent, conducting coated electrical insulating flat plate situated parallel to said grid and separated therefrom by less than 0.4 cm and greater than 0.2 cm, said conducting coating being deposited on the side of said plate facing said grid, said plate further forming a first major side of a gas tight envelope;

b. an alpha particle and light transmitting window adjacent to and parallel to said wire grid, and located on the opposite side of said grid from said plate, said window forming a second major side of said gas tight envelope;

c. means simultaneously secured to said plate and said window for completing said gas tight envelope, and for supporting said electrodes and window;

d. means for introducing and removing target gases from said gas tight envelope, said gases occupying the volume between said window and said conducting coated electrode;

e. means for maintaining said pair of electrodes at particular voltages in order to accelerate electrons released by collisions between alpha particles incident on said volume and said target gas located therein, thereby forming a visible spark discharge; and f. means for quantitatively detecting and recording said spark discharges resulting from said alpha particle collisions.

3. The apparatus as described in claims 1 or 2, wherein said light transparent conducting coated electrical insulating plate is fabricated out of clear plate glass.

4. The apparatus as described in claim 3, wherein said conducting coating consists essentially of tin oxide with a resistance of about 20 ohms per square across said glass plate and such that said coating is transparent.

5. The apparatus as described in claim 4, wherein said wire grid further comprises about 0.02 cm diameter wire spaced at about 1.3 cm intervals.

6. The apparatus as described in claim 5, wherein said wire grid is fabricated from materials which include tungsten wire.

7. The apparatus as described in claim 6, wherein said electrode voltage maintaining means is connected to said conducting coating through an about 20 million ohm limiting resistor, said plate electrode thereby being maintained at about +2000 V relative to said wire grid which is grounded.

8. The apparatus as described in claim 7, wherein said window includes thin polyester film.

9. The apparatus of claim 8 wherein said discharge detecting means includes electronic event counters, and said discharge recording means includes photographic recording.

10. The apparatus as described in claim 9, wherein said target gas includes a flowing, approximately atmospheric pressure gas mixture consisting essentially of about 95–99% argon and about 1–5% isobutane.

* * * * *